US006898867B1

(12) United States Patent
VanderPyl

(10) Patent No.: US 6,898,867 B1
(45) Date of Patent: May 31, 2005

(54) AIR COMPRESSION VARIABLE HEATING SYSTEM

(75) Inventor: Daniel J. VanderPyl, Fullerton, CA (US)

(73) Assignee: Sonic Air Systems, Inc., Fullerton, CA (US)

( * ) Notice: Subject to any disclaimer, the term of this patent is extended or adjusted under 35 U.S.C. 154(b) by 0 days.

(21) Appl. No.: 10/073,035

(22) Filed: Feb. 12, 2002

(51) Int. Cl.[7] ..... F26B 3/00

(52) U.S. Cl. ..... 34/515; 34/446; 34/476; 34/493; 415/58.4

(58) Field of Search ..... 34/446, 448, 476, 34/493, 513, 514, 515; 415/58.4, 151, 156

(56) References Cited

U.S. PATENT DOCUMENTS

| | | | | | |
|---|---|---|---|---|---|
| 2,421,387 | A | * | 6/1947 | Lysholm | 60/650 |
| 2,734,443 | A | * | 2/1956 | Wood | 454/71 |
| 3,835,551 | A | | 9/1974 | Keimpema et al. | 34/100 |
| 3,976,390 | A | * | 8/1976 | Silvern et al. | 415/58.1 |
| 4,308,993 | A | | 1/1982 | Buss | 237/2 A |
| 4,513,571 | A | * | 4/1985 | Jenny et al. | 60/603 |
| 4,685,287 | A | * | 8/1987 | Tajuma | 60/785 |
| 4,817,387 | A | * | 4/1989 | Lashbrook | 60/611 |
| 4,977,690 | A | | 12/1990 | Davis, Jr. | 34/523 |
| 5,020,335 | A | * | 6/1991 | Albers et al. | 62/271 |
| 6,108,938 | A | * | 8/2000 | Jones | 34/487 |
| 6,260,231 | B1 | | 7/2001 | Bybee et al. | 15/309.2 |

* cited by examiner

*Primary Examiner*—Ira S Lazarus
*Assistant Examiner*—Kathryn S. O'Malley
(74) *Attorney, Agent, or Firm*—Michael Fedrick Sheldon & Mak

(57) ABSTRACT

A compressed air supply system for an air drying device such as a blow-off air knife or compressed air manifold with nozzles directed at articles passing on a conveyor therebeneath is provided with a recirculation loop. An adjustably variable portion of the compressed air emanating from the outlet duct of the air compressor is diverted from the air delivery inlet duct leading to the air blow-off device and is a recirculated to the inlet of the air compressor, where it is mixed with ambient air at ambient temperature and pressure. The blower system recirculates between about one percent and eighty percent of the total air flow emanating from the compressor outlet duct to produce a fully adjustable total air temperature rise of up to twenty-five degrees Fahrenheit for each one pound per square inch of blower pressure above ambient air pressure.

5 Claims, 3 Drawing Sheets

AIR COMPRESSION VARIABLE HEATING SYSTEM

BACKGROUND OF THE INVENTION

1. Field of the Invention

The present invention relates to a method and apparatus for increasing the temperature of compressed air supplied to an air drying device in which moisture is evaporated or in which dust and moisture is blown off articles traveling past the device without the requirement for an external heating source.

2. Description of the Prior Art

Air drying or blow off devices, such as air knives or air distribution manifolds having a plurality of nozzles, are utilized extensively in industry for directing air under pressure at passing articles to evaporate or blow off water, dust, and debris from those articles. Conventional air knives and air distribution manifolds are often formed as elongated structures that extend alongside or transverse to a conveyor belt or conveyor chain carrying articles to be dried or blown clean.

Air knives are extensively used for drying a wide variety of articles of manufacture, such as plastic soft drink bottles prior to labeling, printed electronic circuit boards, food packaging, and many other products. Conventional pressurized air drying devices in the form of air knives and air nozzles have been used in a wide variety of industrial and commercial processes to remove or control the amount of liquids remaining on the surfaces of products after washing, rinsing, cooling, coating, or to which lubricating fluids have been applied. These same air drying devices have also been used to blow dust and debris from products, as well as to accelerate the heating or cooling of products. Applications for air knife and air nozzle blow off include the processing of printed circuit boards assemblies, machine parts, fabricated metals, plastic trays and totes, conveyor belts, electroplating, assorted textiles, food production and packaging, car and truck washing, and many other applications as well.

It is advantageous to utilize air heated above ambient temperature to increase the effectiveness of air blow off drying devices, such as air knives and air nozzles. While the compression of air within a single stage blower does raise the temperature somewhat above the temperature of ambient air drawn into the compressor, external heating systems are often utilized to create greater temperature increases than can be supplied by a single stage of compression.

Very typically the compressed air traveling to the air drying device is directed past separate in-line heaters, such as those powered by electricity, natural gas, or forced steam. Such heaters raise the temperature of the compressed air before it emanates from the air knife or air nozzle manifold. The heated, compressed air reduces drying time and reduces heating time associated with a wide variety of manufacturing processes. In some systems, on the other hand, the devices to be treated are preheated before reaching the air knife or air nozzle manifold. While conventional external heating systems of this type are effective in assisting the air blow off drying devices in ridding the articles to be treated of moisture and dust, the capital expense, energy consumed, space requirements, and the maintenance costs involved with such secondary heat sources add considerably to the overall cost of manufacture or treatment of the articles being processed.

One prior system has been devised which recirculates air emanating from an air knife back to a turbine air blower. This system is described in U.S. Pat. No. 6,260,231. In this conventional system air is returned from a recirculation trough that has side plates for condensing moisture from the air. The moisture flows to the bottom of the recirculation trough and drains from the drying modules. Moisture is removed from the air by a filter before the air is returned to the turbine air blower. However, the air recirculated in this system is subjected to the cooling effects of moisture on the printed circuit boards, or other objects to be dried before it is recirculated. Also, the air that is recirculated is not at an elevated pressure.

SUMMARY OF THE INVENTION

A primary object of the present invention is to elevate the temperature of compressed air directed to an air knife or air nozzle system for drying or blowing off articles transported past the air delivery location while avoiding the problems associated with the use of a secondary heating system. According to the present invention a significant temperature increase in the compressed air provided from a single stage centrifugal blower can be achieved by diverting a portion of the compressed air emanating from the compressor outlet and recirculating that portion back to the compressor inlet to be mixed with fresh ambient air.

When a single stage centrifugal blower generates air pressures of from about 0.5 pounds per square inch to about 10.0 pounds per square inch, the mechanical force of compressing the air molecules produces a heat rise over the air temperature of ambient air at the inlet to the blower of about twenty-five degrees Fahrenheit for each pound per square inch of blower pressure. The specific adiabatic efficiency of the blower at various flow levels measured in cubic feet per minute along the blower performance curve can result in an increase or decrease in the average temperature rise by as much as ten percent. That is, the action of compressing air that arrives at an elevated temperature produces a greater increase in temperature at the compressor outlet than the compression of the same amount of air arriving at ambient temperature and pressure at the compressor inlet. This results in superheated air being supplied to the air drying device at a higher temperature than the normal heat of compression.

The present invention eliminates the need for an external heating source for the compressed air supplied to the air drying device. The expenses associated with such devices, previously indicated, are thereby avoided. Instead of the external heat sources and the energy required to power them, the recirculating blower system of the present invention recirculates from one percent to eighty percent of the total cubic feet per minute of air passing through the blower. This is accomplished by connecting a recirculation pipe loop from the blower outlet back to the blower inlet. The system thereby introduces a mixture of fresh air at ambient temperature and pressure with compressed, recirculated air at an elevated temperature to produce a total air temperature rise of up to fifty degrees Fahrenheit for each one pound per square inch of blower pressure. The additional blower horsepower required to generate this additional heat is comparable, and in some cases less, than the energy of a secondary, in-line heater system. In any event, the size, maintenance, and costs associated with a secondary heat system are totally eliminated.

Preferably, the recirculation loop is fully adjustable. That is, the system is preferably provided with a valve that can be variably adjusted to allow up to half of the air emanating from the compressor outlet to be recirculated back to the compressor inlet. The adjustable valve can be partially closed to reduce the amount of air recirculated down to as little as one percent of the air emanating from the compressor outlet. If conditions warrant, the valve can be closed entirely to shut off any flow to the recirculation loop.

In one broad aspect the present invention may be considered to be a method of increasing the air temperature of compressed air flowing to an air drying device through an air delivery inlet duct from an air compressor. The method of the invention is comprised of the steps of: compressing ambient air with the air compressor; directing compressed air flow from the air compressor toward the air delivery inlet duct; diverting a portion of the compressed air flow from the air delivery inlet duct back to the air compressor to raise the temperature of the compressed air flow; and passing the compressed air flow from the air delivery inlet duct to the air drying device. The compressor employed preferably provides compression of between about 0.5 to about 10.0 pounds per square inch above ambient air pressure.

The term air drying device, as used herein, encompasses compressed air knives, compressed air manifolds with outlet nozzles, air blowers, and other compressed air article processing devices that direct a flow of compressed air toward passing objects to dry them or blow moisture, dust, and other contaminants from them. Air drying devices of this type are utilized in the food, beverage, and packaging industries; in metal forming and processing; in parts manufacturing and processing; in wire and cable processing; and in many other commercial and industrial applications.

Preferably the system is arranged so that the portion of the compressed air flow diverted from the air delivery inlet duct can be varied. Typically, between about one percent and about eighty percent of the total air compressed by the air compressor is diverted and recirculated back to the inlet of the air compressor. The portion of the compressed air flow diverted from the air delivery inlet duct is varied to maintain a selected elevated air temperature of compressed air passed to the air drying device.

In another broad aspect the invention may be considered to be a method of elevating the temperature of the compressed air flow to an air drying device through an air delivery inlet duct utilizing an air compressor without externally heating the compressed air flow. The method is comprised of the steps of: drawing ambient air into the air compressor; compressing the ambient air in the air compressor to produce the compressed air flow; recirculating a portion of the compressed air flow back to the air compressor to raise the temperature thereof; and directing the remaining portion of the compressed air flow to the air drying device through the air delivery inlet duct.

Preferably, the portion of the compressed air flowing back to the air compressor is varied and the air compressor provides a pressure increase of between about 0.5 to about 10.0 pounds per square inch above ambient air pressure. The system of the invention may be employed to maintain a predetermined elevation in compressed air temperature above ambient air temperature.

The invention may also be considered to be an improvement in an air blower system for a compressed air drying device employing an air compressor that supplies air under pressure to an air delivery inlet duct. The improvement of the invention comprises a compressed air recirculation loop leading from the air delivery inlet duct back to the air compressor, and a valve for diverting a portion of the air flowing from the compressor toward the air delivery inlet duct back to the air compressor through the recirculation loop. Very typically the air compressor is a single stage centrifugal blower. The valve for the recirculation loop is preferably an adjustable valve, such as a butterfly valve. A valve of this type typically has a manually adjustable operating mechanism, such as a lever or a rotatable knob or valve wheel located externally on the outside of the piping of the recirculation loop.

The invention may be described with greater clarity and particularity by reference to the accompanying drawings.

DESCRIPTION OF THE EMBODIMENT

Figure 1:
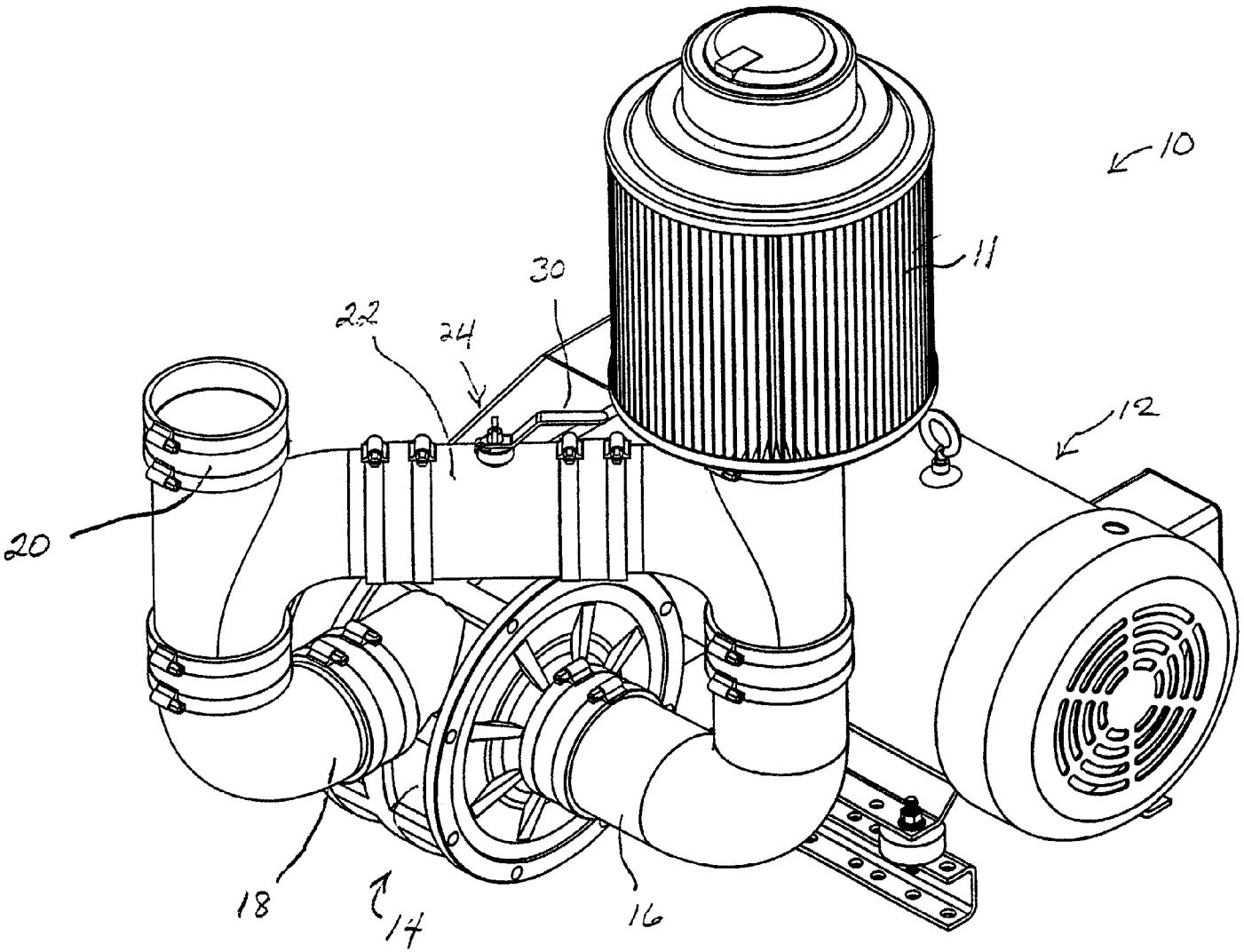
FIG. 1 is a perspective view of a compressed air supply system for an air blow-off or drying device, such as an air knife or an air manifold with a plurality of delivery nozzles.

FIG. 1 illustrates an air blower system 10 modified according to the present invention to provide a compressed air flow to an air drying device such as an air knife or air manifold with air delivery nozzles. Conventional devices of this type are sold by Sonic Air Systems, located at 4111 N. Palm Street, Fullerton, Calif. 92835 as Sonic Blowers, Models 70, 100, 200, and 350. The improved air blower system 10 of the present invention includes an electrically powered belt drive motor 12 that operates a single stage, centrifugal air compressor 14. The motor 12 may operate at one thousand revolutions per minute, for example. The air compressor 14 has a conventional ambient air filter 11 mounted atop an axial inlet duct 16. The air compressor 14 also has a tangential, centrifugal outlet duct 18 leading to an air delivery inlet duct 20 that is coupled to a conventional air knife or other conventional air drying device (not shown).

According to the improvement of the invention the air blower system 10 is provided with a hollow, tubular recirculation loop 22 of cylindrical annular cross section that leads from the compressor air outlet duct 18 back to the compressor air inlet duct 16. The blower system 10 produces an increase in pressure in the compressed air outlet duct 18 of between 0.5 and about 10.0 pounds per square inch above the pressure of ambient air drawn radially into the system through the filter 11. The size and manner of intersection of the recirculation loop 22 with the compressed air outlet duct 18 is such that up to eighty percent of the compressed air flow emanating from the compressed air outlet duct 18 and directed toward the air delivery inlet duct 20 can be diverted into the recirculation loop 22.

Figure 2:
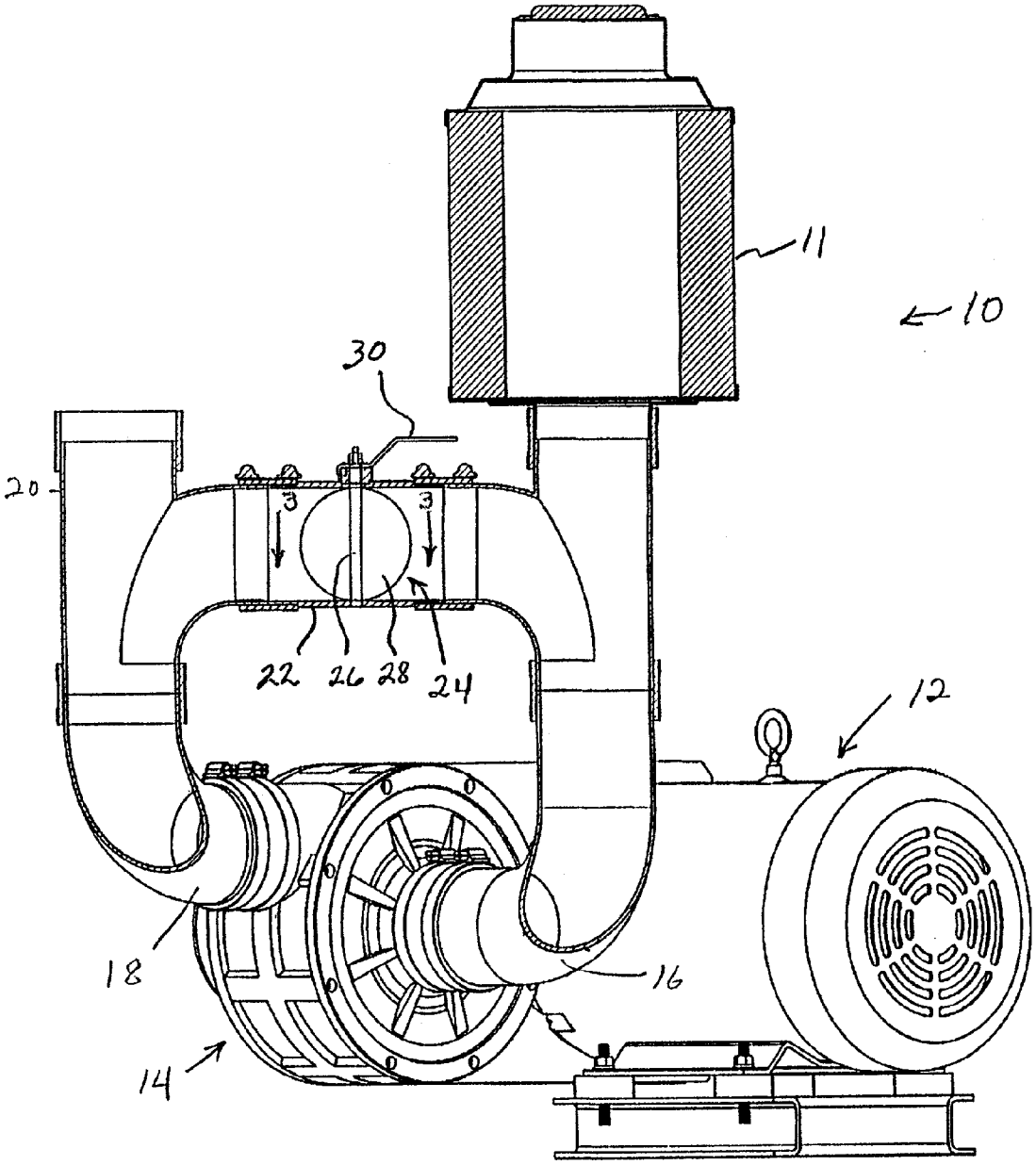
FIG. 2 is another perspective view, partially in section, taken from a different vantage point and illustrating the internal operating mechanisms of the improvement of the invention in the compressed air supply system of FIG. 1.
Figure 3:
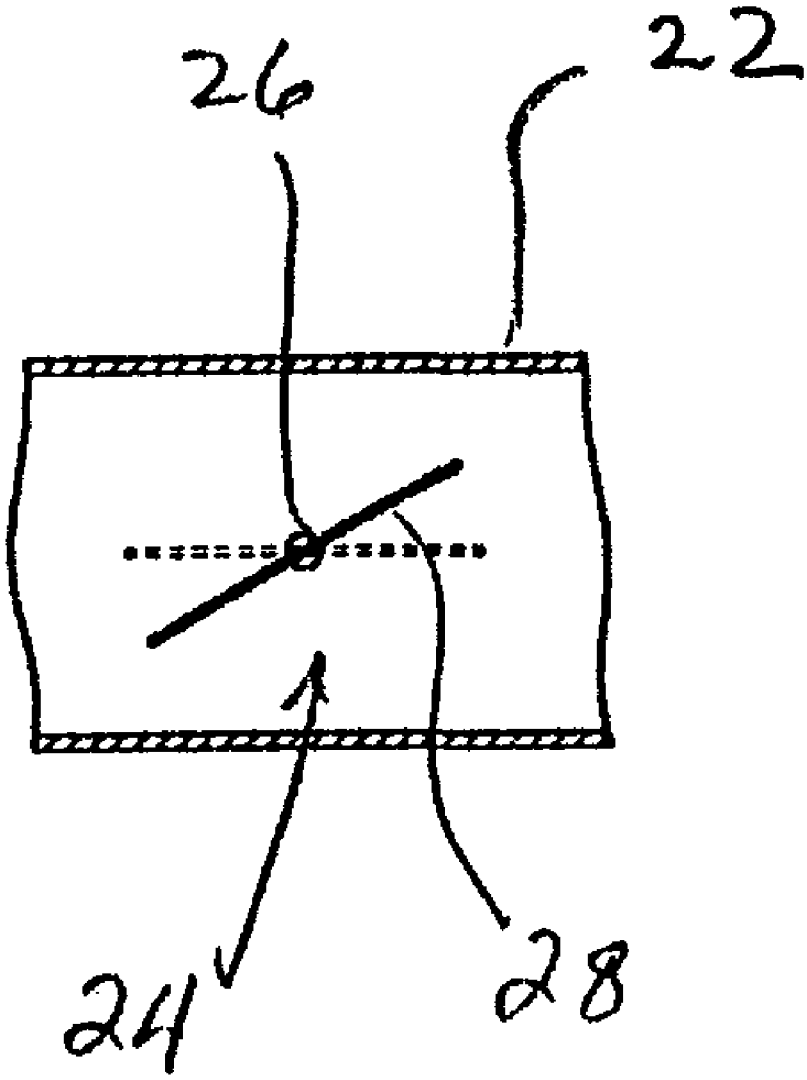
FIG. 3 is a sectional plan detail taken along the lines 3—3 of FIG. 2.

As shown in FIG. 2 the recirculation loop 22 includes an adjustable butterfly valve 24 for diverting a portion of air flowing from the compressed air outlet duct 18 of the compressor 14 toward the air delivery inlet duct 20 back to the inlet duct 16 of the air compressor 14. The butterfly valve 24 is a conventional structure that includes an elongated valve axle 26 having one end rotatably mounted in the annular wall of the recirculation loop 22 and an opposite end projecting through a diametrically opposed opening in the wall of the recirculation loop 22. A disc-shaped butterfly valve plate 28 is welded or otherwise rigidly secured to the valve axle 26. A manual operating lever 30 is secured to the protruding end of the valve axle 26. The butterfly valve handle 30 may be manually operated to vary the effective cross-sectional opening of the recirculation loop 22 at the location of the butterfly valve 24 in an infinitely variable manner. Adjustment of the butterfly valve 24 is illustrated in FIG. 3.

By manipulating the butterfly valve lever 30, a selected portion of the compressed air flowing out of the compressor 14 through the compressed air outlet 18 to the air delivery inlet duct 20 is diverted and recirculated back to the air compressor 14 through the recirculation loop 22. The butterfly valve 24 may be manipulated to maintain a predetermined elevation in compressed air temperature above the temperature of ambient air drawn radially inwardly through the filter 11. Depending upon the position of the butterfly valve 24, between about one percent and eighty percent of the total cubic feet per minute of total compressed air compressed by the compressor 14 and emanating from the compressor outlet duct 18 is recirculated back to the compressor inlet duct 16 and mixed with ambient air drawn in through the air filter 11.

The improved air blower system of the invention introduces a mixture of fresh air at ambient temperature and pressure from the air filter 11 with compressed, recirculated air at an elevated air temperature to produce a fully adjustable total air temperature rise in compressed air reaching the air delivery inlet duct 20 of up to fifty degrees Fahrenheit for each one pound per square inch of blower pressure produced by the compressor 14. The additional power required to drive the air compressor 14 to process the compressed air recirculated through the recirculation loop 22 is more than offset by the advantage of avoiding use of a secondary, external heating source.

Undoubtedly, numerous variations and modifications of the invention will become readily apparent to those familiar with air drying delivery systems. For example, numerous different types of valves may be employed in place of the butterfly valve 24. Also, an automated system with temperature and pressure sensors can be employed in place of the manually operated adjustment lever 30. Accordingly, the scope of the invention should not be construed as limited to the specific embodiment depicted and described herein, but rather is defined in the claims appended hereto.

I claim:

1. A system for treating articles with heated compressed air comprising:

a) conveyor for moving the articles;

b) an air knife oriented to direct air at the moving articles;

c) a motor;

d) an air compressing device driven by the motor;

e) an air inlet to the air compressing device;

f) an air delivery duct from the compressing device for providing air to the air knife at a pressure of from about 0.5 to about 10 pounds per square inch above ambient pressure;

g) an air recirculation loop from the air delivery duct leading from the air delivery duct directly back to the air compressing device inlet so that no recirculated air contacts the motor; and h) a valve for controlling the portion of air flowing from the air compressing device toward the air delivery duct that recirculates back to the air inlet to the air compressing device for heating.

2. The system of claim 1 wherein there is no enclosure separating the compressing device from the motor.

3. The system of claim 1, wherein the air compressing device is a single stage centrifugal blower.

4. The system of claim 1, wherein the valve is an adjustable valve.

5. The system of claim 4, wherein the valve is a butterfly valve.

* * * * *

UNITED STATES PATENT AND TRADEMARK OFFICE

CERTIFICATE OF CORRECTION

PATENT NO. : 6,898,867 B1
DATED : May 31, 2005
INVENTOR(S) : Daniel J. VanderPyl It is certified that error appears in the above-identified patent and that said Letters Patent is hereby corrected as shown below:

Title page,
Item [57], ABSTRACT, please replace with the following:
-- A compressed air supply system for an air drying device such as a blow-off air knife or compressed air manifold with nozzles directed at articles passing on a conveyor therebeneath is provided with recirculation loop. An adjustably variable portion of the compressed air emanating from the outlet duct of the air compressor is diverted from the air delivery inlet duct leading to the air blow-off device and is recirculated to the inlet of the air compressor, where it is mixed with ambient air at ambient temperature and pressure. The blower system recirculates between one percent and eighty percent of the total air volume emanating from the compressor outlet duct to produce a fully adjustable total air temperature rise of up to fifty degrees Fahrenheit for each one pound per square inch of blower pressure above ambient air pressure. --.

Signed and Sealed this

Thirteenth Day of September, 2005

JON W. DUDAS
*Director of the United States Patent and Trademark Office*